United States Patent [19]

Rothbarth et al.

[11] Patent Number: 4,692,771

[45] Date of Patent: Sep. 8, 1987

[54] ANTENNA DISH REFLECTOR WITH INTEGRAL AZIMUTH TRACK

[75] Inventors: James N. Rothbarth, St. Louis, Mo.; Edward W. Smith, Los Angeles, Calif.

[73] Assignee: Satellite Technology Services, Inc., St. Louis, Mo.

[21] Appl. No.: 717,498

[22] Filed: Mar. 28, 1985

[51] Int. Cl.[4] ..... H01Q 3/02; H01Q 3/00

[52] U.S. Cl. ..... 343/882; 343/765; 343/766

[58] Field of Search ..... 343/882, 765, 880, 766; 350/634, 636

[56] References Cited

U.S. PATENT DOCUMENTS

| | | | |
|---|---|---|---|
| 2,410,827 | 11/1946 | Langstroth et al. | 343/765 |
| 2,472,824 | 6/1949 | Hays . | |
| 2,745,098 | 5/1956 | Cady | 343/766 |
| 3,202,015 | 8/1965 | Moul, Jr. et al. | 343/765 |
| 3,255,455 | 6/1966 | Von Trentini . | |
| 3,439,550 | 4/1969 | Goulding | 343/765 |
| 3,527,435 | 9/1970 | Lapp et al. | 343/882 |
| 3,530,477 | 9/1970 | Jarrett et al. . | |
| 3,562,753 | 2/1971 | Tanaka et al. . | |
| 3,628,862 | 12/1971 | Stephenson | 350/636 |
| 3,680,141 | 7/1972 | Karikomi . | |
| 3,713,164 | 1/1973 | Foury . | |
| 3,714,660 | 1/1973 | Scrafford et al. . | |
| 3,845,483 | 10/1974 | Soma et al. . | |
| 3,940,771 | 2/1976 | Wild . | |
| 3,987,452 | 10/1976 | Godet . | |
| 4,044,361 | 8/1977 | Yokoi et al. . | |
| 4,086,599 | 4/1978 | VanderLinden et al. . | |
| 4,118,707 | 10/1978 | Yoshida et al. . | |
| 4,126,865 | 11/1978 | Longhurst et al. | 343/894 |
| 4,199,762 | 4/1980 | Estlick et al. . | |
| 4,204,214 | 5/1980 | Fassnacht | 343/765 |
| 4,225,868 | 9/1980 | Mazur . | |
| 4,251,819 | 2/1981 | Vickland . | |
| 4,282,529 | 8/1981 | Speicher | 343/765 |
| 4,304,381 | 12/1981 | Lloyd . | |
| 4,332,426 | 6/1982 | Speicher . | |
| 4,384,294 | 5/1983 | Crook et al. . | |
| 4,396,919 | 8/1983 | Speicher . | |
| 4,404,565 | 9/1983 | Gurney et al. . | |
| 4,428,248 | 1/1984 | Broucksou et al. | 74/335 |
| 4,433,337 | 2/1984 | Smith et al. . | |
| 4,442,435 | 4/1984 | Kiryu et al. . | |
| 4,450,450 | 5/1984 | Ellingson et al. . | |
| 4,454,515 | 6/1984 | Major et al. . | |
| 4,470,050 | 9/1984 | Ellingson et al. . | |
| 4,490,724 | 12/1984 | Bickman . | |
| 4,491,388 | 1/1985 | Wood . | |
| 4,491,847 | 1/1985 | Estang | 343/765 |

*Primary Examiner*—Charles Frankfort
*Assistant Examiner*—Thomas B. Will
*Attorney, Agent, or Firm*—Rogers, Howell, Moore & Haferkamp

[57] ABSTRACT

An antenna for receiving satellite broadcast television reception only (TVRO) programming, includes a main reflector dish, a pivot tube for pivotally mounting the reflector dish from a support, and an integrally formed azimuth track and drive comprising an arcuate track bolted to the back of the reflector dish with a trolley drive which engages the pivotal mount to drive the reflector dish along the azimuth to move the dish from satellite to satellite. The integral track and drive rides freely in the vertical direction on the pivotal mount to permit adjustment of the declination and elevation of the main reflector dish without disassembly or removal of the azimuth track and drive.

26 Claims, 5 Drawing Figures

FIG. 1.
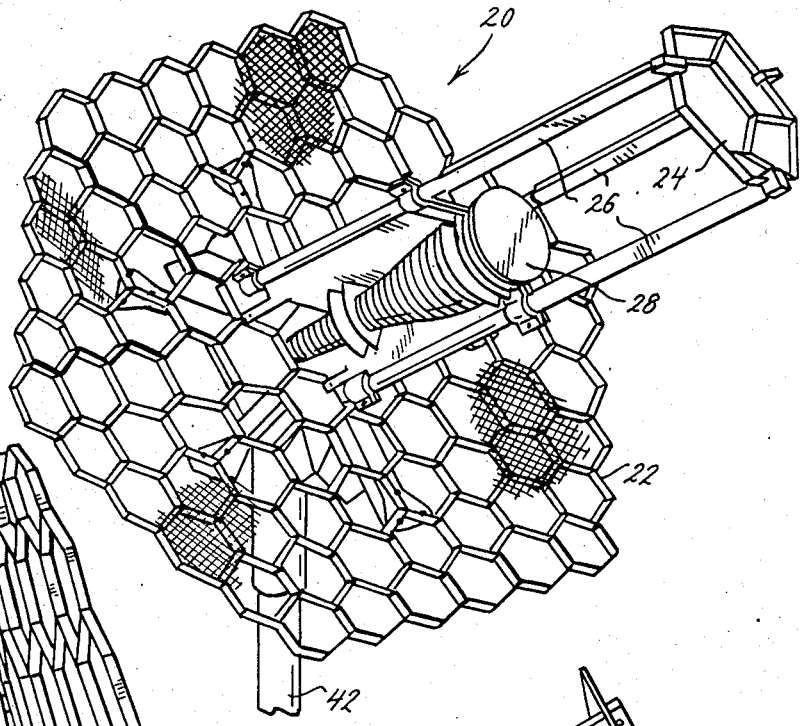
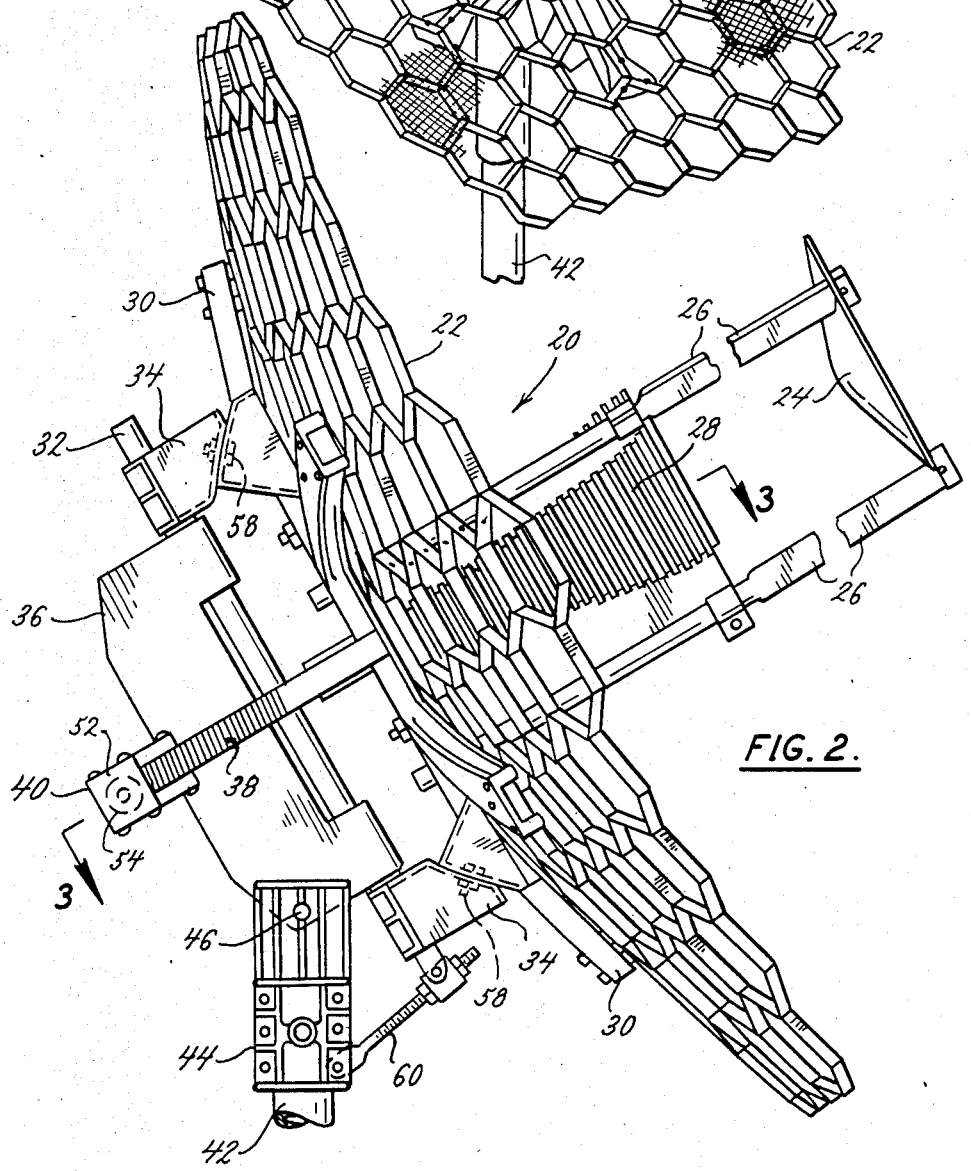
FIG. 2.

ANTENNA DISH REFLECTOR WITH INTEGRAL AZIMUTH TRACK

BACKGROUND AND SUMMARY

Antennas for use in satellite television reception only (TVRO) systems, are well known in the art. These dish-type antennas are used by a homeowner to receive satellite broadcast television programs from any one of a number of satellites in geosynchronous orbit over the equator. Each antenna includes as major components the dish or reflector which is oriented towards the satellite, and a feed which is located at the focal point of the dish. The dish or reflector ranges in size from approximately a four-foot diameter to an eleven-foot diameter and the antennas are generally mounted for rotational movement atop a pole which is anchored in a concrete pad or the like.

One of the reasons for the size of these main reflector dishes is that it is an important factor in determining the quality of the reception. The cross-sectional area of the main reflector dish projected into a plane defines the aperture of the dish, and the larger the aperture, the better the reception, all other things being equal. Therefore, a larger dish size adds to performance, but it creates problems focusing the dish on individual satellites, keeping the dish focused on the desired satellite, and also moving it from satellite to satellite at the operator's command. As the wind picks up velocity, the antenna has a tendency to shift, drift or oscillate, a phenomenon known as mispointing, such that the television reception is degraded. Therefore, it is important to be able to accurately, reliably, and rigidly point and move the dish in spite of the wind.

In the prior art, devices known as antenna actuators are commonly used to position and move the antenna along its azimuth. The antenna actuators generally comprise a longitudinal drive cylinder which is clamped to the pivotal mount with its piston bolted to the rear of the dish. An electric motor is typically used to drive the piston in and out of the cylinder, the piston generally taking the form of a spiral gear, much like a hydraulic jack, to move the antenna dish from side-to-side, and thereby adjust the azimuth. These antenna actuators are generally installed in the field after the elevation and declination of the antenna has been determined and the main reflector dish oriented at the proper angle. As is well known in the art, each installation must separately be adjusted for an initial elevation which is the angle of the pivotal rotation of the dish with respect to horizontal, and the declination of the dish which is the relative angle of the dish with respect to the pivotal rotational axis. After these have been determined, the actuator may then be mounted to provide movement along the azimuth, or in the horizontal direction. Once the actuator is installed, the declination may not be adjusted except by disassembling or removing the actuator.

To solve these and other problems in the prior art, the inventors herein have succeeded in designing an antenna with an integral azimuth track and drive which provides great accuracy and rigidity, and while at the same time permits the declination and elevation of the main reflector dish to be made without disconnection or disassembly of the azimuth drive. This improved integral azimuth drive comprises a generally circular azimuth track which is bolted to the superstructure supporting the main reflector dish, and a trolley drive means which contains a worm gear and motor and which slides over the track. The pivotal mount for the main reflector dish provides a convenient structure to secure the trolley member, so that as the drive motor drives the worm gear, the worm gear drives the track, and the track moves with respect to the pivotal mount instead of vice versa. The trolley member has an enclosure which has integrally formed ears extending along a U-connector, the U-connector being a part of the pivotal mount for the antenna dish. Thus, as the declination of the dish is changed with respect to the pivotal mount, the trolley member ears and enclosure merely slide vertically along the back of the U-connector as the vertical position of the trolley member with respect to the U-connector is irrelevant. It is only necessary that the trolley member be engaged by the U-connector so that as the drive motor turns the worm, the track is moved horizontally instead of the trolley member moving along the track.

Because of the nature of the design, the various portions of the antenna utilized in the azimuth track and drive can be made from injection molded plastic. This includes the main dish supporting superstructure, various portions of the pivotal mount including the U-connector, and the azimuth track and worm gear.

The principal advantages and features of the invention have been described. However, a greater understanding and appreciation for the invention may be obtained by referring to the drawings and detailed description of the preferred embodiment which follows.

BRIEF DESCRIPTION OF THE DRAWINGS

FIG. 1 is a perspective view of a TVRO antenna;

FIG. 2 is a side view of the TVRO antenna of FIG. 1 showing an overall view of the pivotal mount with a declination adjustment and an integrally mounted azimuth track and drive of the present invention;

DETAILED DESCRIPTION OF THE PREFERRED EMBODIMENT

Figure 3:
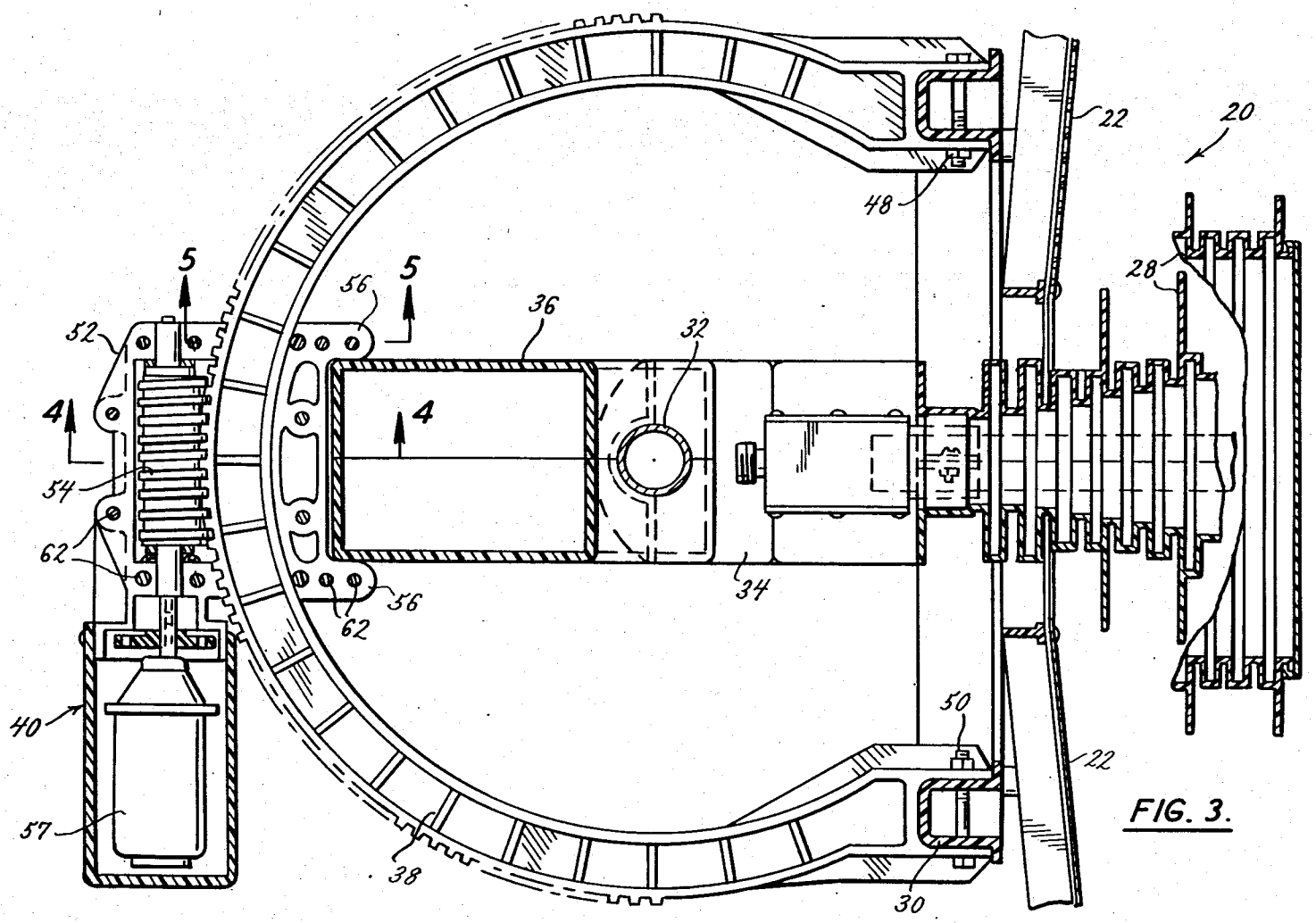
FIG. 3 is a partial cross-sectional view taken along the plane of line 3—3 in FIG. 2 and further detailing the integral azimuth track and drive.

An antenna 20 is shown in FIGS. 1 and 2 and generally includes a main reflector dish 22, a subreflector 24 supported by three spars 26 and a horn 28. As shown in greater detail in FIG. 2, the main reflector dish 22 has a supporting superstructure 30 which is pivotally mounted to a pivot tube 32 by pads 34. A U-connector 36 is also pivotally mounted to pivot tube 32 with azimuth track 38 bolted to superstructure 30 with trolley member 40 mounted to azimuth track 38. U-connector 36 is itself pivotally mounted to a mast 42 by a pivot yoke 44 and nut and bolt assembly 46.

The azimuth track 38 and trolley drive 40 is better detailed in FIG. 3. As shown therein, nut and bolt assemblies 48, 50 mount the ends of the arcuate azimuth track 38 directly to the back-up superstructure 30. The trolley member 40 includes a plastic injection molded trolley case 52 which has a pair of integrally formed ears 56 which straddle U-connector 36 to restrict lateral movement of the trolley member 40 with respect to the U-connector 36. The trolley enclosure 52 includes a worm gear 54 and drive motor 57 which drives worm gear 54 to move azimuth track 38 and, hence, main reflector dish 22 as desired by the operator. Both the azimuth track 38 and worm gear 54 may be molded from a high-strength plastic, such as Valox™ or the like, and the other parts of the antenna including the superstructure 30, pads 34, U-connector 36, and trolley enclosure 52 may be injection molded from styrene or the like.

As best shown in FIG. 2, the declination of the main reflector dish 22 with respect to the pivot tube 32 may be adjusted by nut and bolt assemblies 58 which each extend through a hole (not shown) in superstructure 30 and a slot (not shown) in pads 34 to change the angle of the main reflector dish 22 with respect to pivot tube 32. Also shown in FIG. 2 is an elevation adjust rod assembly 60 which is used to change the angle of pivot tube 32 with respect to mast 42, nut and bolt assembly 46 being the axis about which the elevation rod assembly 60 adjusts the position of the antenna 20.

Figure 4:
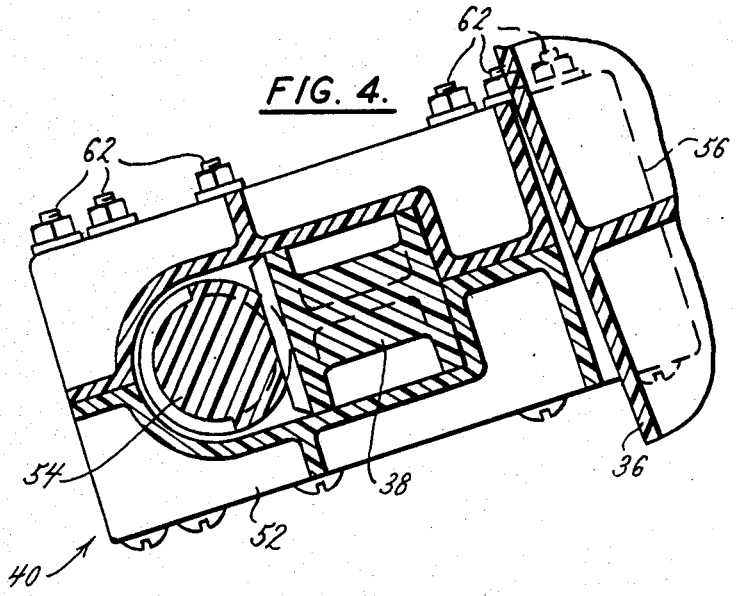
FIG. 4 is a partial cross-sectional view taken along the plane of line 4—4 in FIG. 3 and detailing the mounting of the trolley member to the U-connector.
Figure 5:
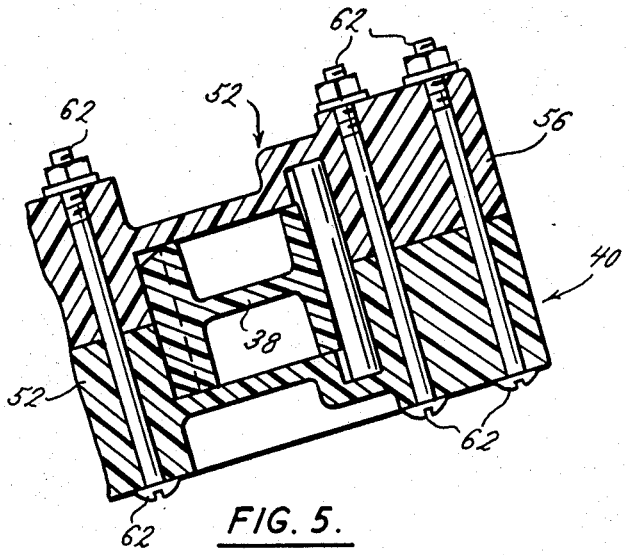
FIG. 5 is a partial cross-sectional view taken along the plane of line 5—5 in FIG. 3 detailing the trolley member mounting to the azimuth track.

As shown in FIGS. 4 and 5, as the declination of the main reflector dish 22 is adjusted with respect to the pivot tube 32, the trolley enclosure 52 slightly cants with respect to U-connector 36, although ears 56 have more than enough length to continue to straddle U-connector 36 and positively engage the trolley assembly 40 and hold it in place as drive motor 56 drives worm gear 54. Thus, the integral azimuth track and drive of the present invention permits adjustment of the declination of the main reflector dish 22 with respect to the pivot tube 32 without disconnection or disassembly thereof. A plurality of bolt and nut assemblies 62 hold together the upper and lower halves of trolley enclosure 52 to encapsulate the track 38. This facilitates the assembly during manufacture of the trolley member 40.

There are various changes and modifications which may be made to applicants' invention as would be apparent to those skilled in the art. However, any of these changes or modifications are included in the teaching of applicants' disclosure and they intend that their invention be limited only by the scope of the claims appended hereto.

What is claimed is:

1. An antenna for receiving satellite broadcast data comprising a main reflector dish, means pivotally mounting said main reflector dish from a support, means to adjust the declination of the dish with respect to the pivotal mounting means, and means to selectively move said main reflector dish about said pivotal mounting means, said moving means comprising an integrally mounted arcuate track and drive means, said arcuate track being secured to the rear of the main reflector dish wherein said arcuate track and drive means are mounted so as not to interfere with the declination adjustment of the dish with respect to the pivotal mounting means.

2. The device of claim 1 wherein said track is fixedly secured to the rear of the main reflector.

3. The device of claim 2 wherein said drive further comprises a trolley member mounted to said arcuate track, and means to drive said trolley member along said track.

4. The device of claim 3 further comprising means to hold said trolley member in place as the trolley driving means moves the trolley member along the track to thereby move the track and main reflector dish.

5. The device of claim 4 wherein the track is injection molded from plastic.

6. The device of claim 4 wherein said trolley holding means is associated with the pivotal mounting means, and is freely movable as the declination of the main reflector dish is adjusted.

7. The device of claim 6 wherein the pivotal mounting means comprises a pivot tube, said main reflector dish having a superstructure supporting said dish, said superstructure being pivotally mounted to said pivot tube, a U-connector pivotally mounted to said pivot tube and pivotally mounted to said support, said trolley member holding means comprising integrally formed ears on said trolley member to positively engage said U-connector.

8. The device of claim 7 wherein said antenna is a TVRO antenna.

9. The device of claim 7 wherein said trolley driving means comprises a worm gear and motor.

10. In an antenna for receiving satellite broadcast data, said antenna comprising a main reflector dish, means pivotally mounting said main reflector dish from a support, and means to adjust the declination of the dish with respect to the pivotal mounting means, the improvement comprising an integrally mounted track and drive means to controllably move said main reflector dish about said pivotal mount, said track and drive means comprising a generally arcuate track secured to the back of the main reflector dish and a drive means, said track and drive means having means permitting adjustment of the declination of the main reflector dish with respect to the pivotal mount.

11. The device of claim 10 wherein the track is fixedly secured to the back of the main reflector dish.

12. The device of claim 11 wherein the track substantially surrounds the pivotal mounting means.

13. The device of claim 11 wherein the drive means comprises a trolley mounted to the track.

14. The device of claim 13 wherein the track and drive declination permission means comprises means on the trolley to engage the pivotal mount and thereby drive the track as it operates.

15. The device of claim 14 wherein the trolley engaging means comprises a pair of ears extending toward said pivotal mounting means to thereby capture said pivotal mounting means therebetween.

16. The device of claim 15 wherein the drive means further comprises a worm gear to engage the track and a motor to drive the worm gear.

17. The device of claim 16 wherein the track and worm gear are made from injection molded plastic.

18. The device of claim 17 wherein the antenna is a TVRO antenna.

19. The device of claim 14 wherein the pivotal mounting means comprises a pivot tube, said main reflector dish having a superstructure supporting said dish, said superstructure being pivotally mounted to said pivot tube, a U-connector pivotally mounted to said pivot tube, and pivotally mounted to said support, said trolley engaging means comprising integrally formed ears on said trolley member to positively engage said U-connector.

20. In a TVRO antenna for receiving satellite broadcast television signals, said antenna comprising a main reflector dish, means pivotally mounting said main reflector dish from a support, and means to adjust the declination of the dish with respect to the pivotal mounting means, the improvement comprising an integrally mounted arcuate track and drive means to controllably move said main reflector dish about said pivotal mount, said track and drive means comprising a generally arcuate track fixedly secured to the back of the main reflector dish and substantially surrounding the pivotal mounting means, said drive means comprising a trolley member mounted to the track and having means to engage the pivotal mount, said trolley member including a worm gear to engage the track, and a motor to drive the worm gear wherein said arcuate tack and drive means are mounted so as not to interfere with the declination adjustment of the dish with respect to the pivotal mounting means.

21. The device of claim 20 wherein the trolley member has an enclosure, and wherein the means to engage the pivotal mount includes ears integrally formed in said trolley enclosure.

22. The device of claim 21 wherein the trolley enclosure is made from injection molded plastic.

23. The device of claim 22 wherein the track and worm gear are made from injection molded plastic.

24. The device of claim 23 wherein the pivotal mounting means comprises a pivot tube, said main reflector dish having a superstructure supporting said dish, said superstructure being pivotally mounted to said pivot tube, a U-connector pivotally mounted to said pivot tube and pivotally mounted to said support, said ears engaging said U-connector on opposite sides thereof to thereby capture said U-connector therebetween.

25. The device of claim 24 wherein the U-connector and the superstructure are made from injection molded plastic.

26. The device of claim 20 wherein the trolley engaging means has means permitting adjustment of the declination of the main dish with respect to the pivotal mount.

* * * * *